US008375673B2

(12) United States Patent
Evjen

(10) Patent No.: US 8,375,673 B2
(45) Date of Patent: Feb. 19, 2013

(54) METHOD AND APPARATUS FOR INTERCONNECTING PANELING

(76) Inventor: John M. Evjen, Gainesville, FL (US)

( * ) Notice: Subject to any disclaimer, the term of this patent is extended or adjusted under 35 U.S.C. 154(b) by 0 days.

(21) Appl. No.: 10/228,672

(22) Filed: Aug. 26, 2002

(65) Prior Publication Data

US 2004/0035079 A1 Feb. 26, 2004

(51) Int. Cl.
*E04B 2/08* (2006.01)
*E04B 2/00* (2006.01)

(52) U.S. Cl. ..... 52/592.1; 52/588.1; 52/589.1

(58) Field of Classification Search ..... 52/309.9, 52/592.1, 586.2, 591.1, 592.2, 592.4, 590.1, 52/591.3, 588.1, 589.1
See application file for complete search history.

(56) References Cited

U.S. PATENT DOCUMENTS

| | | | | |
|---|---|---|---|---|
| 1,527,684 | A | 2/1925 | Hull | |
| 1,823,039 | A | 2/1930 | Gruner | |
| 1,776,188 | A | 9/1930 | Langbaum | |
| 2,740,167 | A * | 4/1956 | Rowley | |
| 3,202,067 | A | 8/1965 | Michard et al. | |
| 3,301,147 | A | 1/1967 | Clayton et al. | |
| 3,538,819 | A | 11/1970 | Gould et al. | |
| 3,740,914 | A | 6/1973 | Diez | |
| 3,859,000 | A | 1/1975 | Webster | |
| 4,226,064 | A | 10/1980 | Kraayenhof | |
| 4,426,820 | A * | 1/1984 | Terbrack et al. | 52/594 |
| 4,845,907 | A | 7/1989 | Meek | |
| 5,050,362 | A | 9/1991 | Tal et al. | |
| 5,098,218 | A | 3/1992 | Reese et al. | |
| 5,502,939 | A * | 4/1996 | Zadok et al. | 52/309.9 |
| 5,630,304 | A * | 5/1997 | Austin | 52/384 |
| 5,706,621 | A * | 1/1998 | Pervan | 52/403.1 |
| 5,797,237 | A * | 8/1998 | Finkell, Jr. | 52/589.1 |
| 5,860,267 | A | 1/1999 | Pervan | |
| D406,360 | S | 3/1999 | Finkell, Jr. | |
| 6,006,486 | A | 12/1999 | Moriau et al. | |
| 6,021,615 | A | 2/2000 | Brown | |
| 6,023,907 | A | 2/2000 | Pervan | |
| 6,029,416 | A * | 2/2000 | Andersson | 52/592.1 |
| 6,101,778 | A | 8/2000 | Martensson | |
| 6,182,410 | B1 * | 2/2001 | Pervan | 52/403.1 |
| D442,296 | S | 5/2001 | Külik | |
| D442,297 | S | 5/2001 | Külik | |
| D442,298 | S | 5/2001 | Külik | |
| D442,706 | S | 5/2001 | Külik | |
| D442,707 | S | 5/2001 | Külik | |

(Continued)

FOREIGN PATENT DOCUMENTS

| | | | |
|---|---|---|---|
| CA | 991373 A | * | 6/1976 |
| DE | 2159042 A | * | 11/1971 |

(Continued)

OTHER PUBLICATIONS

English Translation of JP 07300979, Nov. 1995.*

*Primary Examiner* — William Gilbert
*Assistant Examiner* — Elizabeth A Plummer
(74) *Attorney, Agent, or Firm* — Saliwanchik, Lloyd & Eisenschenk

(57) ABSTRACT

A paneling system is provided herein that concerns interconnecting panels with opposite connecting sides of substantially tongue in groove joint couplings and opposing adjacent connecting sides that are of substantially hook-joint coupling. The hook joint hinders lateral motion while permitting movement in a direction perpendicular to the plane of the interconnected panels to provide ease of installment and removal. The hook joints also provide proper alignment and spacing between panels.

38 Claims, 8 Drawing Sheets

U.S. PATENT DOCUMENTS

| | | | | |
|---|---|---|---|---|
| 6,247,286 | B1 | 6/2001 | Heyns | |
| D449,119 | S | 10/2001 | Külik | |
| D449,120 | S | 10/2001 | Külik | |
| D449,391 | S | 10/2001 | Külik | |
| D449,392 | S | 10/2001 | Külik | |
| 6,332,733 | B1 * | 12/2001 | Hamberger et al. | 403/329 |
| 6,418,683 | B1 | 7/2002 | Martensson et al. | |
| 6,421,970 | B1 | 7/2002 | Martensson et al. | |
| 6,446,405 | B1 * | 9/2002 | Pervan | 52/403.1 |
| 6,490,836 | B1 | 12/2002 | Moriau et al. | |
| 6,510,665 | B2 * | 1/2003 | Pervan | 52/589.1 |
| 6,516,579 | B1 * | 2/2003 | Pervan | 52/403.1 |
| 6,532,709 | B2 * | 3/2003 | Pervan | 52/403.1 |
| 6,536,178 | B1 * | 3/2003 | Palsson et al. | 52/589.13 |
| 6,546,691 | B2 | 4/2003 | Leopolder | |
| 6,588,166 | B2 | 7/2003 | Martensson et al. | |
| 6,591,568 | B1 | 7/2003 | Palsson et al. | |
| 6,647,690 | B1 | 11/2003 | Martensson | |
| 6,684,592 | B2 | 2/2004 | Martin | |
| 6,772,568 | B2 | 8/2004 | Thiers et al. | |
| 6,808,777 | B2 * | 10/2004 | Andersson et al. | 428/47 |
| 7,892,617 | B2 * | 2/2011 | Bathelier et al. | 52/588.1 |
| 7,897,005 | B2 * | 3/2011 | Knauseder | 156/304.5 |
| 8,001,741 | B2 * | 8/2011 | Duernberger | 52/591.1 |
| 8,038,363 | B2 * | 10/2011 | Hannig et al. | 52/588.1 |
| 2001/0034991 | A1 | 11/2001 | Martenson et al. | |
| 2002/0007606 | A1 | 1/2002 | Kettler et al. | |
| 2002/0007608 | A1 | 1/2002 | Pervan | |
| 2002/0007609 | A1 | 1/2002 | Pervan | |
| 2002/0017071 | A1 | 2/2002 | DeVivi | |
| 2002/0152707 | A1 | 10/2002 | Martensson | |
| 2002/0178673 | A1 | 12/2002 | Pervan | |
| 2002/0178674 | A1 | 12/2002 | Pervan | |
| 2003/0079820 | A1 | 5/2003 | Palsson et al. | |
| 2003/0233809 | A1 | 12/2003 | Pervan | |
| 2004/0068954 | A1 | 4/2004 | Martensson | |
| 2004/0177584 | A1 | 9/2004 | Pervan | |
| 2004/0211144 | A1 | 10/2004 | Stanchfield | |
| 2005/0016107 | A1 | 1/2005 | Rosenthal et al. | |
| 2009/0199502 | A1 * | 8/2009 | Eisermann | 52/589.1 |

FOREIGN PATENT DOCUMENTS

| | | | |
|---|---|---|---|
| EP | 715037 | A1 * | 6/1996 |
| FR | 2 667 639 | A1 | 11/1991 |
| GB | 647812 | | 12/1950 |
| JP | 07300979 | A * | 11/1995 |
| JP | 2002004552 | A | 1/2002 |
| WO | WO 93/13280 | | 7/1993 |
| WO | WO 94/26999 | | 11/1994 |
| WO | WO 97/47834 | | 12/1997 |
| WO | WO 99/66151 | | 12/1999 |
| WO | WO 0047841 | A1 * | 8/2000 |
| WO | WO 00/63510 | A1 | 10/2000 |
| WO | WO 01/66877 | A1 | 9/2001 |

* cited by examiner

METHOD AND APPARATUS FOR INTERCONNECTING PANELING

FIELD OF THE INVENTION

The subject invention relates to a method and apparatus for paneling. In a specific embodiment, the subject invention pertains to paneling used in the installation and disassembly of floor covering systems or wall panels.

BACKGROUND OF INVENTION

Floor panels having either substantially rectangular or square shapes can be installed in various ways. Generally, it is desirable to have a floor covering composed of panels positioned together to form tight fitting joints and an outer appearance devoid of large gaps or cracks. It is also desirable that the panels be easily and quickly assembled and disassembled to reduce installation time and costs. Previous techniques in assembling snap-together paneling systems involved careful planning in positioning and laying panels end to end to form an aesthetically pleasing covering. Once the panels were laid out and presented a desired covering, they were permanently attached to an underlying floor, either by means of gluing or nailing. Disadvantages of this installation method are that installation is complex and time consuming and disassembly requires the panels be broken from the underlying floor. Further, this floor covering does not take into account the inevitable expansion or shrinkage of the floor covering and/or sub-flooring due to changes in humidity and/or temperature. Thus, the floor panels can drift apart and result in the formation of undesired gaps, for example, in those joints where the glue connection is broken.

To address these problems, various techniques for constructing impermanent as well as permanent floor coverings using interconnecting floor panels have been proposed. For example, U.S. Pat. No. 6,006,486 discloses a flooring system in which interconnecting floor panels are engaged at the edges with tongue and groove coupling elements. These floor panels can be installed by snapping connecting edges together by means of a pure lateral translation movement or by means of a turning movement. Tongue and groove coupling joints provide both lateral and vertical locking elements between panels, whereby lateral locking elements resist movement in a direction parallel to the plane of the underlying floor and vertical locking elements resist movement in a direction perpendicular to the plane of the underlying floor. Where all of the side edges of a panel are tongue and groove joint elements, installation of such floor panels requires considerable physical manipulation to connect the floor panels without disengaging the joints of adjacent panels. Thus, floor panels that are interconnected using solely tongue and groove joints on all side edges are difficult to assemble and disassemble.

Further examples of interlocking floor panels include those commonly referred to as floating parquet flooring. The floor panels in this system are installed loosely to a sub-flooring. These floor panels mutually interconnect with each other by means of a tongue and groove coupling, and are further attached together with the application of glue at the tongue and groove connection. The floor covering obtained in this manner is difficult to disassemble. In addition, assembling the flooring system was particularly messy when the excess glue leaked from between the joints.

Additional panel designs with interconnecting elements include U.S. Pat. No. 5,050,362, which discloses construction panels for roofing and the like having interconnecting sides that "define a connection which is highly resistant to both clockwise and counter-clockwise movements applied about a connection axis" (column 3, lines 53-56). U.S. Pat. No. 3,538,819 discloses air field matting having interconnecting members. Finally, U.S. Pat. No. 4,845,907 discloses interlocking panel modules usable for decking sections in poultry operations. While these panels disclose various interconnecting means, they do not provide optimum, durable panel coupling while ensuring ease of assembly or disassembly.

Thus, these and other known panels used to form floors, walls, cladding, and the like do not effectively provide snap-together panels for various uses that may be speedily installed and/or disassembled while also providing tight joints between panels and durability of covering. Present covering systems generally involve panels with adjacent sides having couplings that are difficult to install, often requiring either substantial rotation of more than one panel to interconnect the panels or else requiring simple rotation followed by forcible action to "snap" a tongue joint element into a groove joint element. Thus, assembly and disassembly of these coverings require a great deal of time and energy. Consequently, there still exists a need for a paneling system that is aesthetically appealing, durable, and provides ease of installation and disassembly.

BRIEF SUMMARY

The subject technology provides an improved paneling system. The subject paneling system can incorporate interlocking panels having a pair of opposite connecting sides with substantially tongue and groove joint elements and at least one pair of opposite connecting sides with substantially complementary lateral motion limiting joint elements. In a specific embodiment, the subject substantially tongue and groove joint elements can be snap-together tongue and groove joint elements. In embodiments of the subject invention the complementary lateral motion limiting joint elements are male and female hook joint elements. In a specific embodiment, the panel has four sides with substantially tongue and groove joint elements located on opposite sides and substantially complementary lateral motion limiting joint elements located on the remaining opposite sides. Another embodiment according to the subject invention provides panels with six sides, having one tongue joint element, one groove joint element, and two of each substantially complementary lateral motion limiting joint elements. In embodiments where a panel has more than one of each complementary lateral motion limiting joint element, identical joint elements can be adjacently located on the panel. Thus, on a panel with more than one pair of complementary lateral motion limiting joint elements, a male hook joint element can be located adjacent another male hook joint element. The male hook joint elements can be located opposite from their complementary female hook-joint elements.

Installation of the subject paneling system, such as a floor covering, can commence with preparation of the desired area with materials well-known by the skilled artisan. For example, metal clips 50 and 51 may be placed over open joint elements of the panels to be situated along the outermost row of the desired area. A first panel is then placed on a sub-flooring. A second panel is aligned next to the first panel so that the male hook joint element of the second panel is placed over the female hook joint element of the first panel. A third panel is then aligned next to the second panel so that the male hook joint element of the third panel is placed over the female hook joint element of the second panel. These steps can be repeated along one length of an area that requires paneling.

A fourth panel can be attached to the first and, optionally to a second panel, by manipulating the fourth panel into an "up-rotated" position and inserting the tongue joint element of the fourth panel into corresponding groove joint elements of the first and second panel. By rotating the fourth panel downward, the tongue joint element of the fourth panel is connected with the groove joint elements of the first and second panels to form a tight-fitting joint. Further, if the fourth panel is connected to the first and second panels, the connection between the first, second, and fourth panels advantageously limits vertical movement along the hook joint between the first and second panels.

A fifth panel can be installed adjacent the fourth panel by aligning the male hook joint element of the fifth panel with the female hook joint element of the fourth panel. The aligned fifth panel is then manipulated into the "up-rotated" position and its tongue joint element is inserted into the groove joint elements of the second and third panels. Advantageously, when rotating the fifth panel downward to form a tongue and groove joint with the second and third panels, the fourth panel is also easily secured with the fifth panel. Specifically, as the tongue and groove joint elements of the fifth, second and third panels are engaged through the downward rotation of the fifth panel, the side of the fifth panel having a male hook joint element is simultaneously coupled to an adjacent side of the fourth panel having a female hook joint element. Downward rotation of the fifth panel simultaneously accomplishes the coupling of at least two sides of the fifth panel to adjacent panels (second, third, and fourth panels) through tongue and groove elements as well as hook joint elements. These steps are repeated as necessary until a desired area is covered by the subject paneling system. The final steps to complete the installation process is well understood by those skilled in the art. For example, a metal clip 50 or 51 may be placed into the un-used joint elements of the final row of panels to provide a "finished" quality to the paneling system.

To disassemble a paneling system according to the present invention, the fifth panel, or the last panel installed in the paneling system, is merely rotated into the upward position to disengage the male hook joint of the fifth panel from the female hook joint of the fourth panel. The tongue joint element of the fifth panel is then withdrawn from the groove joint elements of the second and third panels to disengage the fifth panel from the paneling system. The remaining panels are disengaged accordingly.

According to the subject invention, two very distinct limitations on panel movement are conferred by the two different joint elements that run along the side edges of the panels. The interconnection of tongue and groove joint elements hinders movement both parallel and perpendicular to the tongue and groove joint connection in the plane of the panels. In contrast, the interconnection of hook joint elements allows substantial movement perpendicular to the plane of the panels while limiting lateral movement in a direction perpendicular to the hook joint connection between the interconnected sides of the panels. By applying a combination of two forms of connection means to panel sides, namely tongue and groove joints and lateral motion limiting joints along opposite edges, the subject invention advantageously enables the user to easily assemble and disassemble a paneling system, such as a floor covering.

In order to facilitate the understanding and description of the present invention a brief description of the basic design and function of known tongue and groove joint elements, herein incorporated by reference, are described below with reference to FIGS. 1A to 1F in the accompanying drawings.

FIG. 1A is a cross-section illustration of tongue-and-groove joint elements of two panels 1 and 1' according to WO 9426999 and WO 9966151 (owner Välinge Aluminium AB), herein incorporated by reference. The tongue and groove joint edges 4*a*, 4*b* of the panels 1 and 1' on an underlying ground surface U are joined together by means of downward angling. In an embodiment, the panel 1 has a flat strip 6 which extends throughout the length of the side 4*a* and which is made of flexible, resilient sheet material. The strip 6 is formed with a locking element 8 extended throughout the length of the strip 6. The locking element 8 has in its lower part an operative locking surface 10. When a floor is being laid, this locking surface 10 coacts with a locking groove 14 formed in the underside of the joint edge portion 4*b* of the opposite side of an adjoining panel 1'.

Moreover, for mechanical joining of the sides in the vertical direction (direction D2) the panel 1 is formed with a tongue joint element 20 along joint edge portion 4*a*. At the bottom, the groove joint element 16 is defined by the respective strip 6. At the opposite edge portion 4*b*, there is an upper recess defining a locking tongue 20 that coacts with the recess 16.

FIGS. 1B to 1F illustrate further tongue-and-groove joint elements of various laminated floor systems. FIG. 1B shows a tongue-and-groove joint according to WO 9426999, herein incorporated by reference. The operative locking surface 10 of the locking element 8 has an inclination (hereinafter termed locking angle) of about 80° to the plane of the board. The locking element has an upper rounded guiding part and a lower operative locking surface. The rounded upper guiding part, which has a considerably lower angle than the locking surface, contributes significantly to positioning of the boards in connection with installation and facilitating the sliding-in of the locking element into the locking groove in connection with angling and snap action. The vertical connection is designed as a modified tongue-and-groove joint, the term "modified" referring to the possibility of bringing the tongue groove and tongue together by way of angling.

FIG. 1C illustrates a tongue-and-groove joint according to WO 9426999 and WO 9966151 and FIG. 1D shows a tongue-and-groove joint according to WO 9747834, all of which are herein incorporated by reference. All of these tongue-and-groove joints are essentially based on the above known principles.

Other known tongue-and-groove locking systems for mechanical joining of board materials are described in, for example, GB-A2,256,023 (herein incorporated by reference), and FIG. 1E, which illustrates a cross-section of the tongue and groove joint of a floor paneling system disclosed by U.S. application Ser. No. 09/954,180 (Darko) herein incorporated by reference. Further, FIG. 1F illustrates a tongue-and-groove joint according to WO 9966151, herein incorporated by reference.

Unlike current panels where only substantially tongue and groove joint elements are located along the side edges of the panels, the panel of the present invention includes complementary lateral motion limiting joint elements to provide lateral locking while permitting substantially movement in the direction perpendicular to the plane of the panels. Further, in an embodiment of the present invention, negligible forcible action is required to engage or disengage hook-joint couplings, thus allowing ease of installation and disengagement of panels. Hook joints also provide proper alignment and spacing between the panels. Another embodiment provides complementary lateral motion limiting joint elements that include a "snap-in" mechanism to hinder movement in the direction perpendicular to the plane of the panels.

The present invention provides panels that can be interconnected to one another to make up a paneling system in which each of the individual panels is interconnected by a mechanical interconnecting system that can be quickly connected together at the installation site without the need for tools or fastening means. As a safeguard against water penetration or to provide a permanent connection between panels, an embodiment of the present invention includes a means for sealing along the joint couplings at the edges of the interlocked panels. The sealing means may include water-resistant or water proof materials such as oil, wax, thermoplastic or thermosetting substances, or glue.

The present invention further provides panels that can be easily and quickly disassembled from one another. According to the present invention, disassembly of interconnected panels may be performed by tilting a panel upward along a tongue and groove joint, which will cause the tongue coupling element to disengage from the groove coupling element while simultaneously unhooking the hook joint couplings along the sides of the panel.

According to the present invention, a paneling system is provided which is relatively easy to install and remove. The present invention also provides a paneling system that may be installed or disassembled in relatively little time.

Further, the subject invention provides a versatile paneling system in which individual panels may be composed of ceramic, wood, and other similar materials. By way of example, the panels contemplated by the subject invention are composed of wood planks or parquet squares in shapes that can be inter-fitted together in various different patterns simply by snapping together the panels to make a covering.

The present invention further provides an extremely flexible paneling system that can be configured to meet the requirements of complex floor plans or wall configurations, including those floor plans that involve intersecting passageways and several associated rooms.

A panel according to the subject invention may have a top side covered by a wood veneer or other attractive wear surface, and an underside which may be covered by a rubber cushion layer. The present invention confers simplicity of design, ease of assembly, and a significant decrease in the amount of time and labor required for installation. These same advantages are conferred in disassembly and reassembly, if desired. The advantages of the subject invention apply to panels of any thickness as well as to panels that serve a variety of purposes. For example, the present invention is applicable to indoor and outdoor floors and walls, where the panels have a variety of shapes and thickness.

DETAILED DISCLOSURE

Figure 1A:
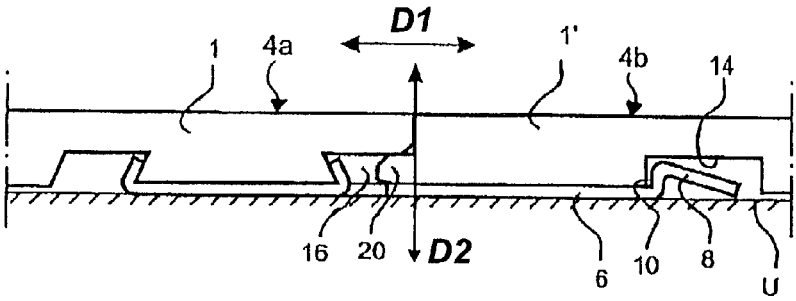
FIG. 1A (Prior Art)
FIGS. 1A-1F illustrate various known tongue-and-groove joint elements.
Figure 1F:
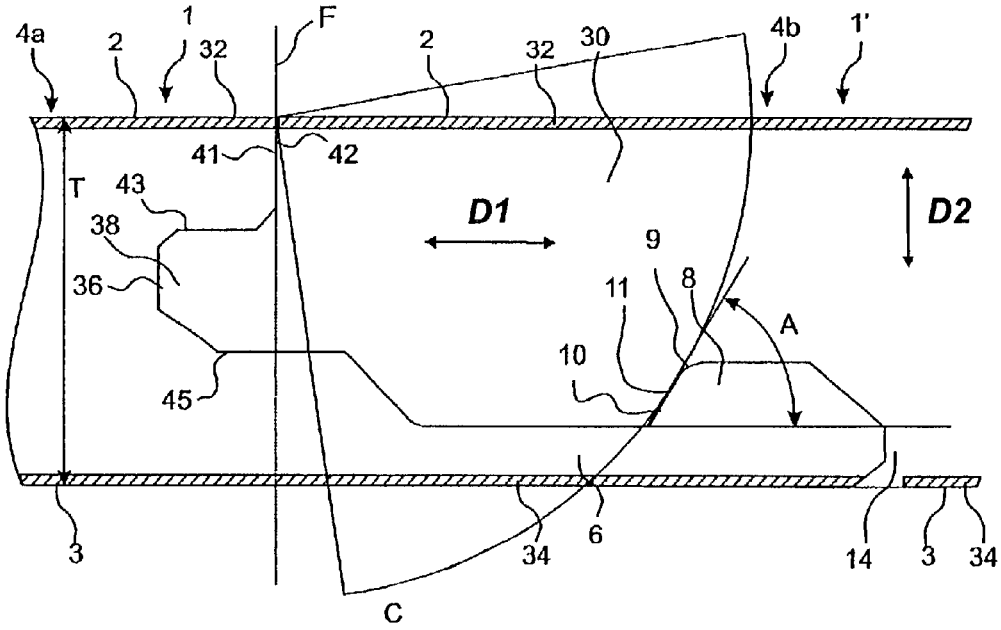
FIG. 1F (Prior Art)
Figure 1B:
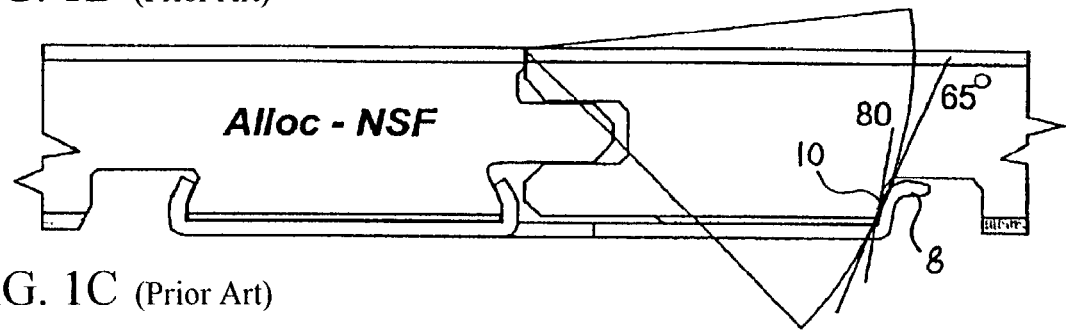
FIG. 1B (Prior Art)
Figure 1C:
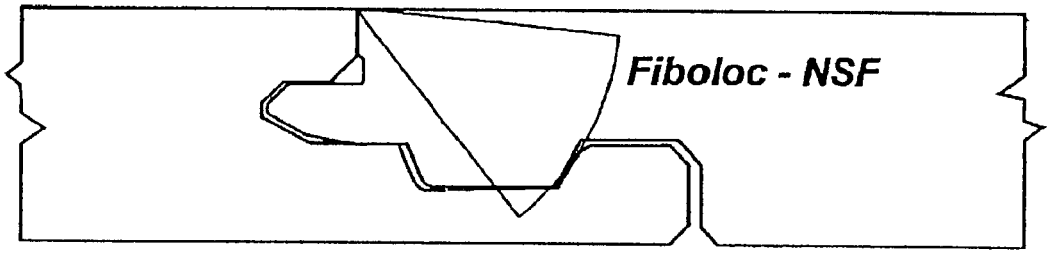
FIG. 1C (Prior Art)
Figure 1D:
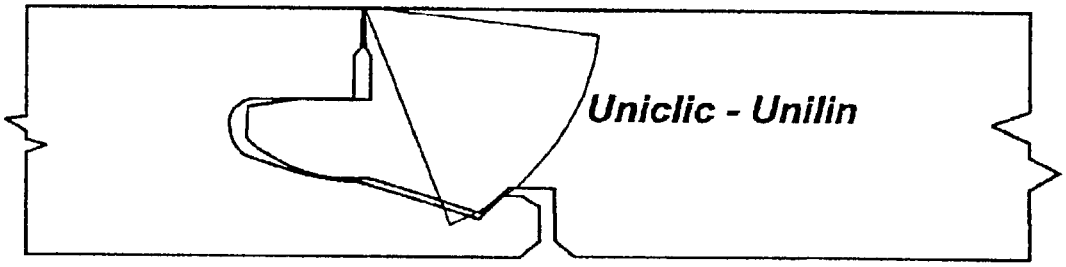
FIG. 1D (Prior Art)
Figure 1E:
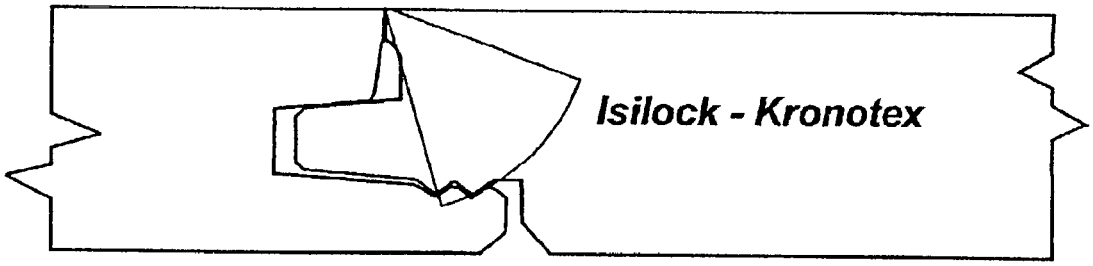
FIG. 1E (Prior Art)
Figure 3:
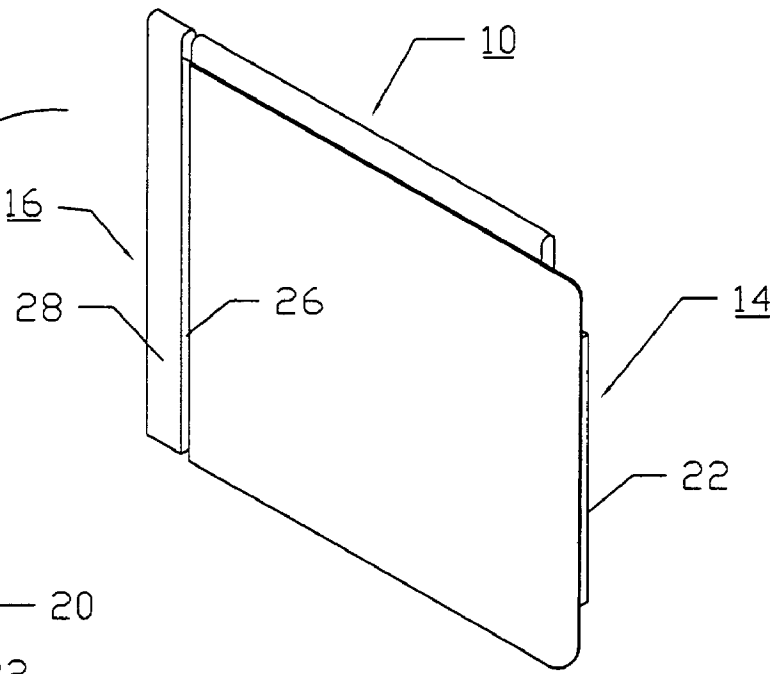
FIG. 3 illustrates a corresponding representation of a perspective bottom view of a panel identical to the panel of FIG. 1.
Figure 2:
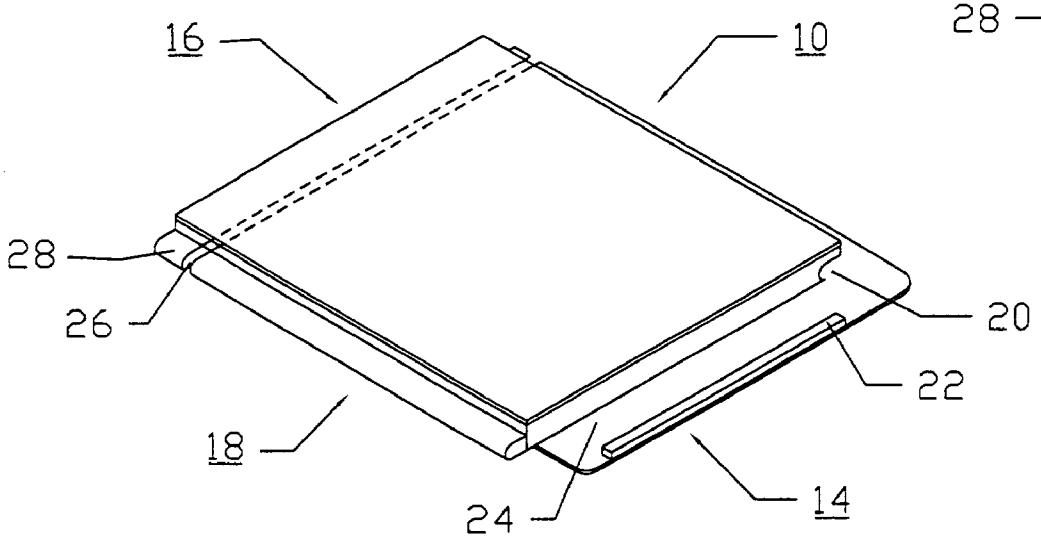
FIG. 2 illustrates a top perspective view of a panel according to the present invention.

The present invention, as illustrated in FIGS. 2 and 3, provides panels 10 which can be interconnected to one another. In a specific embodiment, each panel can be identical to other panels. A panel 10 includes a top, a bottom, and joint elements along the sides of panel 10. A panel 10 has two forms of connecting means provided by joint elements that run along opposite edges of the same panel 10. According to the present invention, one form of connecting means is provided by a lateral motion limiting female joint element 14 and a lateral motion limiting male joint element 16. The other form of connecting means is provided by a tongue joint element 18 and a groove joint element 20. The joint elements may take the form of formations formed within the panel at manufacture. By providing different joint elements along opposite edges of the panel 10, the subject paneling system effectively achieves a system for connecting panels to one another in a quick and easy manner without the need for tools or glue.

Lateral motion limiting joint elements 14, 16 are located at opposites sides of the same panel 10. Where more than one of each lateral limiting joint element 14, 16 are provided on the same panel 10, for example with panels comprising more than four sides, like lateral motion limiting joint elements are located at adjacent sides. A lateral motion limiting joint is provided when the lateral motion limiting male joint element 16 is placed over the lateral motion limiting female joint element 14. The lateral motion limiting joint substantially prevents movement in a direction perpendicular to the lateral motion limiting joint in the plane of the interconnected panels. Further, according to the present invention, the lateral motion limiting joint elements advantageously provide ease of panel installation and disassembly because the lateral motion limiting joint elements can simply be connected through a downward motion, substantially perpendicular to the plane of the panels.

In contrast, the connection of tongue and groove joint elements requires either sufficient application of lateral force to drive the tongue joint element into the groove joint element or insertion at an angle of the tongue joint element into the groove joint element followed by the downward rotation of the tongue joint element to insert the tongue joint element into the groove joint element. The subsequent tongue and groove joint formed by the connection of tongue and groove joint elements inhibits panel 10 movement in a direction perpendicular to the plane of the panels as well as movement in a direction perpendicular to the tongue and groove joint in the plane of the panels.

Tongue joint element 18 and groove joint element 20 are located opposite to each other on the remaining side edges of the same panel 10. A tongue-and-groove joint is formed when the tongue-joint element 18 is rotated into the groove joint element 20. The tongue-and-groove joint provides a locking mechanism between a first panel 10 and another panel 10 that prevent movement in a direction perpendicular to the plane of the panels as well as movement in a direction perpendicular to the tongue and groove joint in the plane of the panels.

In an embodiment, the panel 10 has a lateral motion limiting female joint element 14 that is a female hook joint element and a lateral motion limiting male joint element 16 that is a male hook joint element. The female hook joint element 14 and the male hook joint element 16 are located along opposite side edges of a panel 10. The female hook joint element 14 is formed from a downwardly directed channel 24 created by an upwardly projected rib 22. The male hook joint element 16 is formed from an upwardly directed channel 26 created by a downwardly projected rib 28. An embodiment of the subject invention has female hook joint element 14 formed from a downwardly directed wedge-shaped channel 24 and an upwardly projected, wedge-shaped rib 22. The complementary male hook joint element 16 is formed from an upwardly directed wedge-shaped channel 26 and a downwardly projected, wedge-shaped rib 28. In a preferred embodiment, the female hook joint element 14 is formed from a downwardly directed substantially rectangular shaped channel 24 and substantially rectangular shaped, upwardly projected rib 22. The complementary male hook joint element 16 is formed from an upwardly directed substantially rectangular shaped channel 26 and a substantially rectangular shaped, downwardly projected rib 28.

To begin installing a paneling system according to the present invention, a first panel 10 is placed at a corner edge of a desired area. The first panel is positioned such that the tongue joint element 18 and the lateral limiting male joint element 16 abut the outermost edge of the area to be paneled. 18. A second panel 10 is then aligned next to the first panel 10 such that the lateral limiting male joint element 16 of the second panel 10 corresponds with the lateral limiting female joint element 14 of the first panel 10. The second panel 10 is then placed over the first panel 10 such that the lateral limiting male joint elements 14, 16 are connected to form a tight joint. Additional panels may be installed accordingly along the length of the edge of the area to be paneled. A skilled artisan knows of various means for "fixing" the first row of panels to be installed. For example, a metal clip 50 or 51 may be placed over the unused joint elements 18 or 20, of the first row of panels. A third panel 10 may then be aligned with the first and second panels 10 such that the tongue joint element 18 of the third panel 10 is inserted into the groove joint elements 20 of the first and second panels 10. When the third panel 10 is rotated downward, the tongue joint element 18 of the third panel is situated into the groove joint element 20 of the first and second panels 10 to form a tight joint between the panels.

Figure 4A:
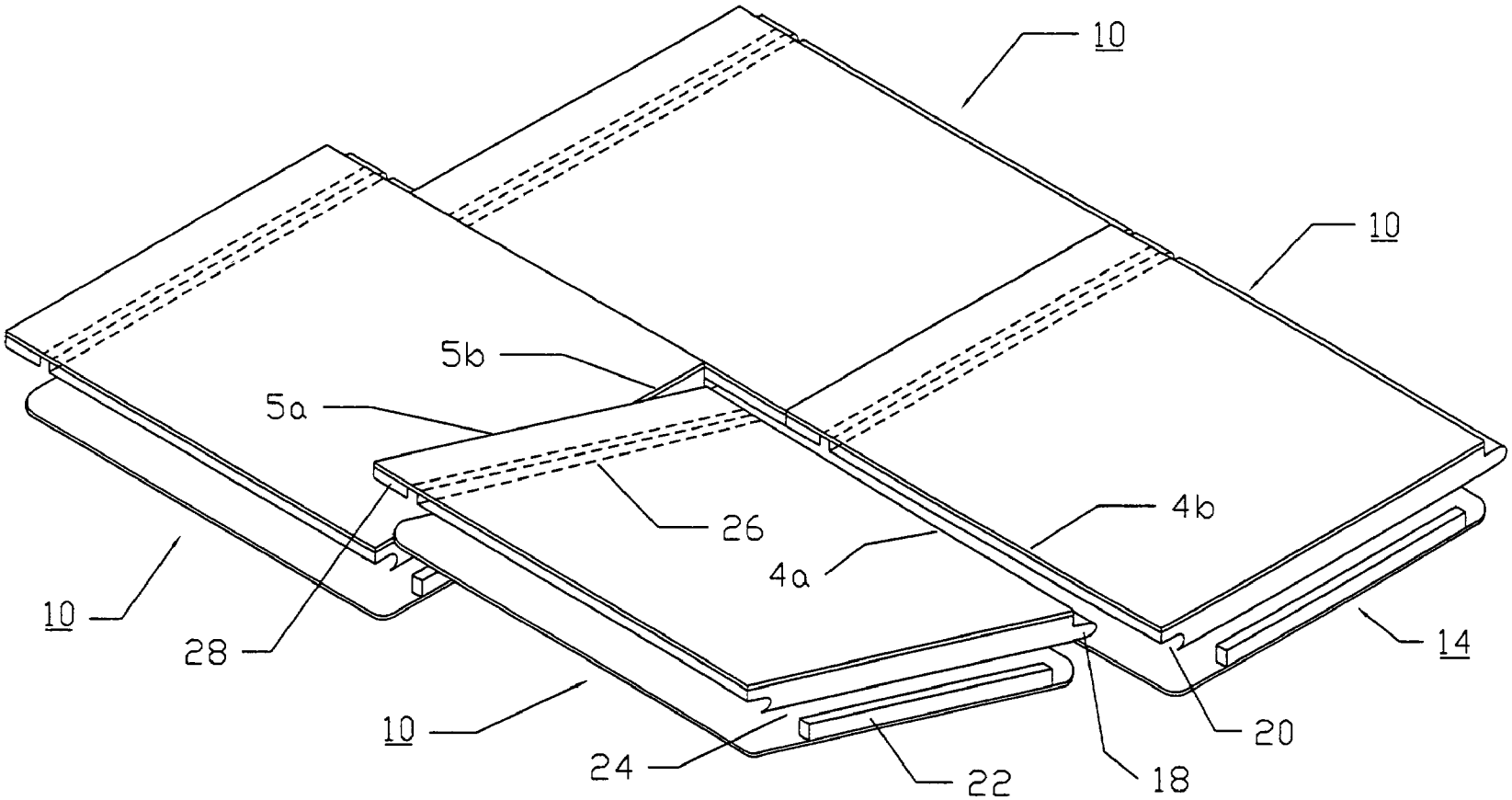
FIGS. 4A-4B illustrate two stages of a method for interconnecting panels incorporating both tongue-and-groove joint elements and hook joint elements.
Figure 4B:
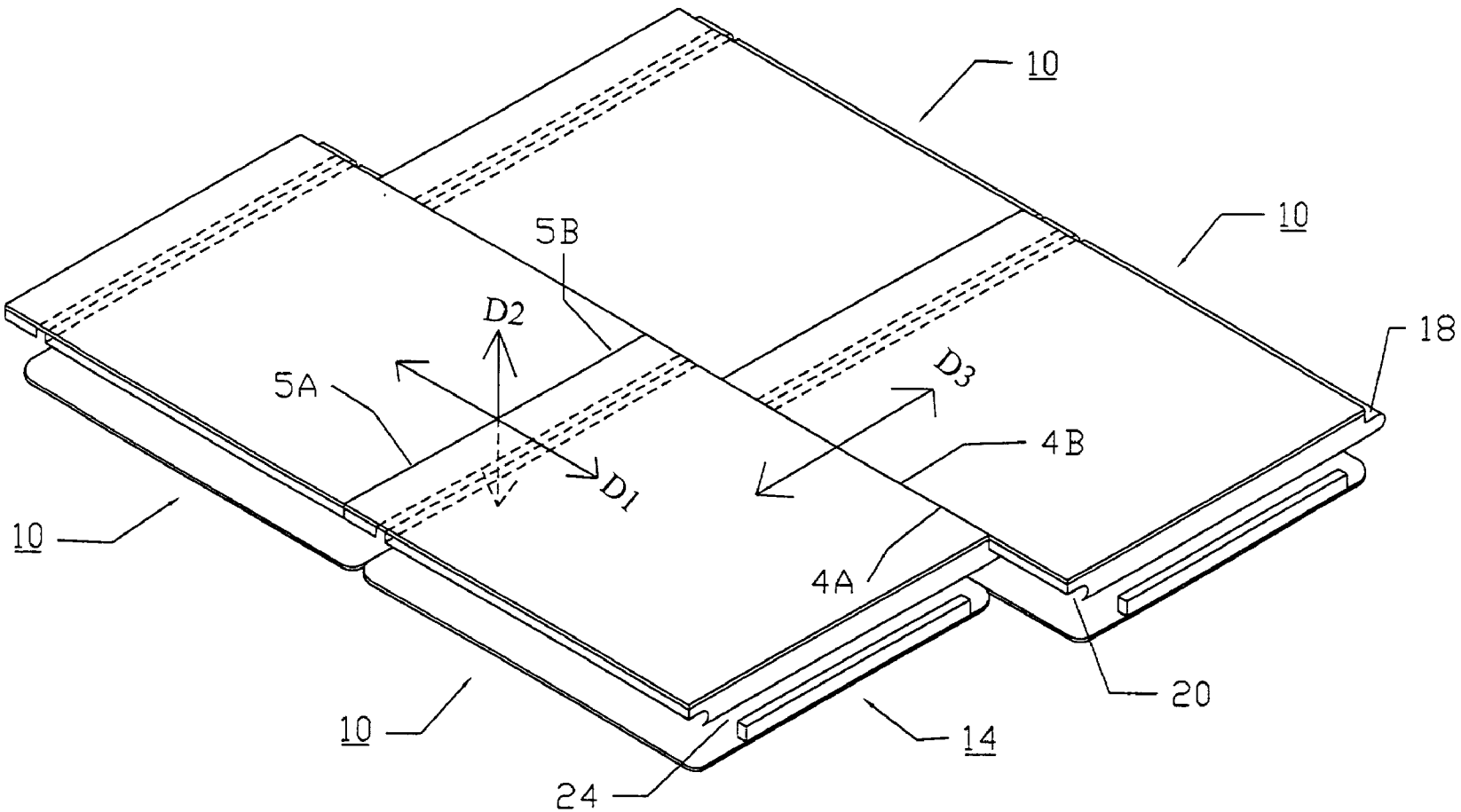

When installing a fourth panel 10 to previously installed first, second, and third panels 10 along their side edge portions 4*a*, 4*b* and 5*a*, 5*b* as shown in FIGS. 4A-4B, the side edge portion 4*a* of a fourth panel 10 is rotated up against the side edge portion 4*b* of a first panel 10 as shown in FIG. 4A, so that the tongue joint element 18 of the fourth panel 10 is introduced to the groove joint element 20 of the first and second panels 10. The fourth panel 10 is then rotated downwards towards the sub floor. By this downward rotation, the tongue joint element 18 of the fourth panel 10 enters the groove joint element 20 of the first and second panels 10 completely. In addition, during this downward rotation of the first panel 10, the lateral motion limiting male hook joint element 16 of the fourth panel 10 is placed over the lateral motion limiting female hook joint element 14 of a third panel 10 to easily attach the fourth panel 10 to a previously installed adjacent third panel 10.

In the joined position as shown in FIG. 4B, the side edges 4*a*, 4*b* of the fourth and first panels 10 are locked in both the direction D3 and the direction D2, and the adjacent edges 5*a*, 5*b* of fourth and third panels 10 are interconnected by lateral motion limiting joint elements, to limit the motion of the panel in at least the direction D1. In an embodiment of the present invention, the lateral motion limiting male and female hook joints incorporate a feature that limits movement in a direction perpendicular to plane of the panels (D2) without application of significant force. For example, referring to FIG. 4B, the feature that limits movement in a direction perpendicular to the plane of the panels creates the necessity for the application of additional force in the D2 direction to move one panel relative to the other.

A further advantage provided by the installation of fourth panel 10 to the established interlocked panels (first, second, and third panels) is the additional restriction of movement in the direction of D2 of the lateral limiting motion joint of the first and second panels 10. Specifically, because the installation of the fourth panel 10 bridges the lateral limiting motion joint created between the first and second panels 10, additional restraint of panel movement in the D2 direction at the lateral limiting motion joint is established. By installing panels in a staggered pattern so that lateral limiting motion joints are bridged by adjacent panels, as illustrated in FIGS. 4A and 4B, the interconnection between panels is reinforced. Once the paneling system has been installed, the skilled artisan understands those steps necessary to "finish" or "fix" the paneling system. For example, a metal clip 50 or 51 may be placed over the un-used joint elements of the final row of panels to "finish" the paneling system.

To disassemble the paneling system according to the present invention, the last panel 10 that was installed is rotated into an up-rotated position to disengage the coupling of the lateral limiting joint elements 14, 16 of the last panel and its neighboring panel. The last panel 10 is then lifted away from the paneling system in the up-rotated position to disengage the tongue joint element 18 from the groove joint element 20 of installed panels. The remaining panels are disassembled accordingly.

Figure 5A:
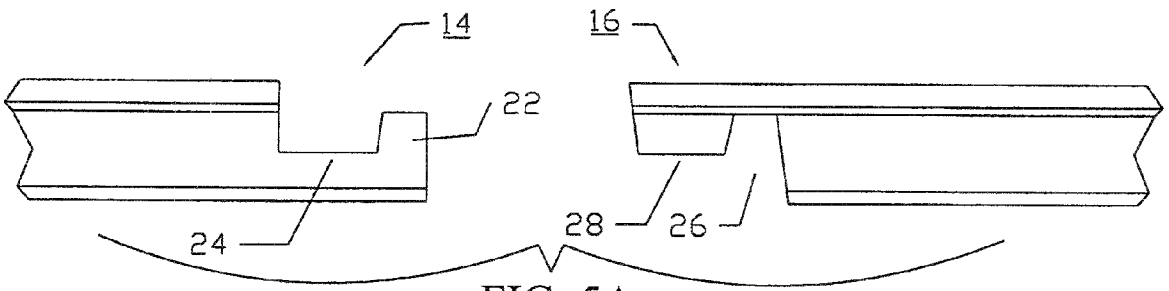
FIGS. 5A-5C are cross-section illustrations of the hook joint elements according to the present invention.
Figure 5B:
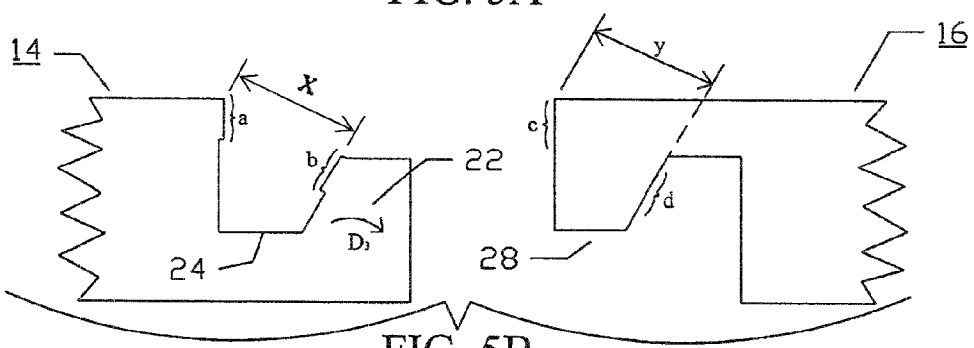
Figure 5C:
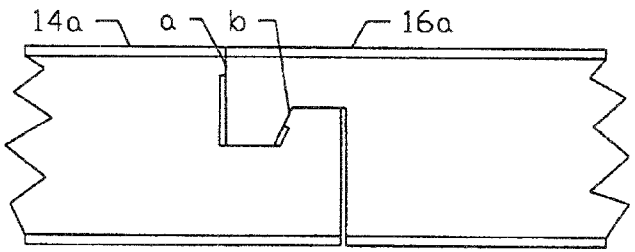

The combination of tongue-and-groove joint locking system with a hook joint locking system provides an improved snap-together paneling system. As illustrated in FIGS. 5A, 5B, and 5C, an embodiment of the invention provides a female hook joint element 14 formed from a downwardly directed channel 24 and upwardly projected rib 22. A male hook joint element 16 is formed from an upwardly directed channel 26 and downwardly projected rib 28. When the male hook joint element 16 is placed over female hook joint element 14, the downwardly projected rib 28 of the male hook joint element 16 is placed into a corresponding downwardly directed channel 24 of the female hook joint element 14. Simultaneously, the upwardly projected rib 22 of the female hook joint element 14 is inserted into the corresponding upwardly directed channel 26 of the male hook joint element 16. The ribs 28, 22 advantageously align and create a tight joint between the lateral top surfaces 14a, 16a of the panels when the ribs 28, 22 are inserted into the corresponding channels 24, 26.

In another embodiment of the invention, the female hook joint element 14 and the male hook joint element 16 includes surface components a, b, c, and d that ensure tight and seamless lateral limiting motion joints between panels. Specifically, the dimension y of the downwardly projected rib 28 of the male hook joint element 16 is greater than dimension x of the downwardly directed channel 24 of the female hook joint element 14 depending on the combined tolerance of dimension x and dimension y. The difference in size between the downwardly projected rib 28 and-the downwardly directed channel 24 establish an "interference" between the joint elements 24 and 28. The interference provides tension and ensure a secure joint between panels by the deflection of the upwardly projected rib 22 of the female hook joint element 14 in the direction of D3. Thus, the tension and interference in movement at the surface components a, b, c, and d would vary from zero to maximum tolerance between the combined tolerances of dimensions x and y. In a preferred embodiment, the dimension y is greater than dimension x by a small amount depending on the rigidity and tolerance of movement of the upwardly projected rib 22.

As illustrated in FIG. 5C, the interconnected hook joint elements 14, 16 form a tight joint between the lateral top surfaces 14*a*, 16*a* due to tension and interference in movement at the surface components a, b.

Figure 6:
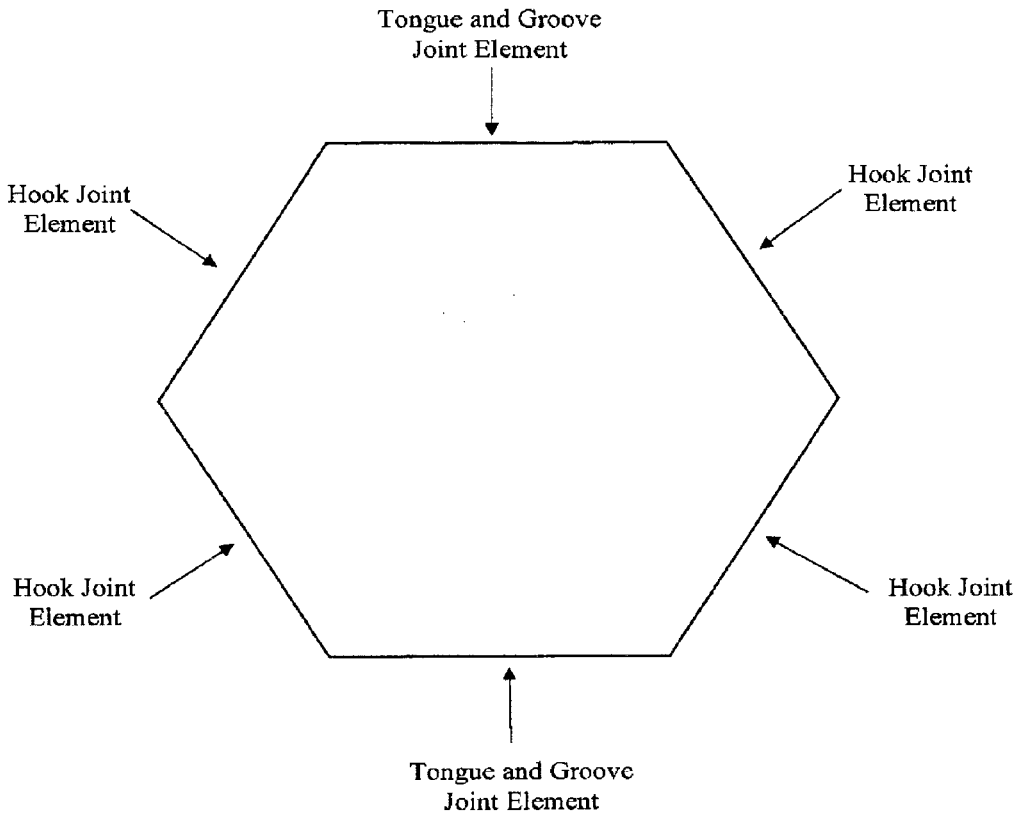
FIG. 6 illustrates a hexagonal panel in accordance with an embodiment of the present invention.
Figure 7:
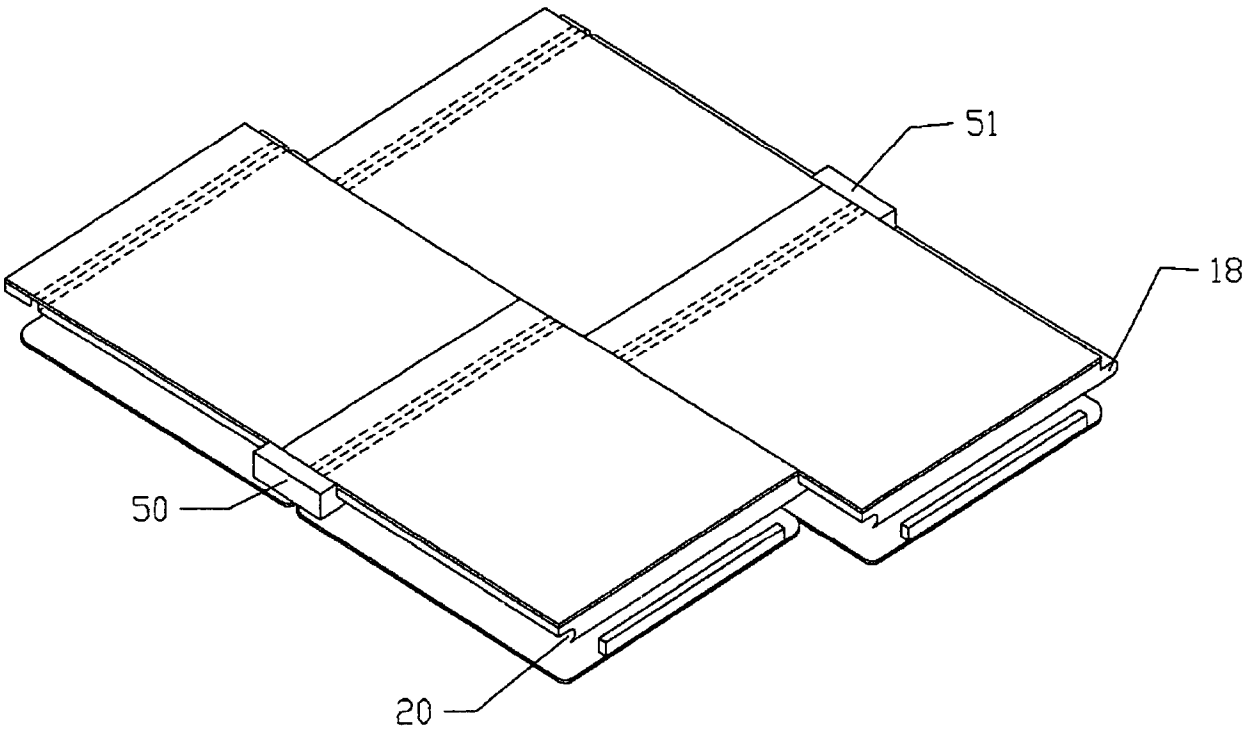
FIG. 7 illustrates an embodiment incorporating clips that can be used to fix the first row of panels and the final row of panels.

The panels 10 may be of any shape and width to fit a desired pattern and/or the size of a surface on which the paneling system is to be laid. An embodiment of the subject invention comprises panels 10 having an even number of sides greater than two. In embodiments of the subject invention where the panel has an even number of sides greater than four, identical hook joint elements are located adjacent to each other. An embodiment provides a panel 10 in the shape of a hexagon, as shown in FIG. 6. In a preferred embodiment, the panel 10 is a parallelogram and substantially rectangular or square in shape. In further embodiments, the side edges including the tongue joint element and the groove joint element are identical in length and are different in length from the side edges including the lateral motion limiting joint elements.

Further, according to the subject invention, the panels 10 may be constructed of known materials suitable in forming such coverings as walling, flooring, or the like including, for example wood composite, ceramic, vinyl, and glass. The panels 10 need not be, but are preferably, made of a uniform material. In an embodiment, the panels 10 are of rectangular or square shape and composed of a wood composite, ceramic, or vinyl. In another embodiment, the panels 10 are elongated and rectangular in shape and composed of laminated wood composite.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

I claim:

1. An interconnecting paneling system, comprising: a plurality of interconnecting panels, wherein each of the panels comprises a side edge having a tongue, a side edge having a groove that is complementary to the tongue, at least one side edge having a lateral motion limiting male joint element, and at least one side edge having a lateral motion limiting female joint element that is complementary to the lateral motion limiting male joint element, wherein the side edge having the tongue and the side edge having the groove are located at opposite sides on each of the panels, wherein the at least one side edge having the lateral motion limiting female joint element and the at least one side edge having the lateral motion limiting male joint element are located at opposite sides of each of the panels, wherein the tongue of each of the panels is configured to interconnect with the groove of another panel to form a tongue and groove joint such that the interconnected panels lie in a plane of the interconnected panels, wherein the tongue and groove joint prevents lateral movement of the interconnected panels away from and toward each other in a direction perpendicular to the tongue and groove joint in the plane of the interconnected panels and prevents movement of the interconnected panels with respect to each other in a direction perpendicular to the plane of the interconnected panels, wherein the tongue and groove joint is rotatably engageable, wherein the lateral motion limiting female joint element of each of the panels is configured to interconnect with the lateral motion limiting male joint element of another panel to form a hook joint such that the interconnected panels lie in the plane of the interconnected panels, wherein the hook joint prevents movement of the interconnected panels away from and toward each other in a direction perpendicular to the hook joint in the plane of the interconnected panels, wherein the hook joint allows movement of the interconnected panels with respect to each other in a direction perpendicular to the plane of the interconnected panels, wherein the hook joint hinders motion of the interconnected panels in a direction perpendicular to the plane of the interconnected panels, wherein the motion of the interconnected panels in a direction perpendicular to the plane of the interconnected panels is hindered via an interference fit between the lateral motion limiting male joint element and the lateral motion limiting female joint element created when the hook joint is formed, wherein the interference fit is due to tension between the lateral motion limiting male joint element and the lateral motion limiting female joint element when the hook joint is formed, wherein the lateral motion limiting male joint element comprises a downwardly projected rib and the lateral motion limiting female joint element comprises a downwardly directed channel for receiving the rib to form the hook joint, wherein the channel comprises a first channel wall that forms a first angle greater than zero with a normal to the plane of the interconnected panels and a second channel wall that is parallel to the normal of the plane of the interconnected panels, wherein the rib comprises a corresponding first rib wall that forms a second angle greater than zero with the normal to the plane of the interconnected panels and the second rib wall that is parallel to the normal of the plane of the interconnected panels, wherein a channel distance between a top of the first channel wall and a top of the second channel wall is less than a rib distance between a top of the first rib wall and a top of the second rib wall resulting in the interference fit when the hook joint is formed, wherein the downwardly directed channel comprises a first channel raised surface component on the first channel wall and a second channel raised surface component on the second channel wall, and wherein when the hook joint is formed the first channel raised surface component pushes on the first rib wall and the second channel raised surface component pushes on the second rib wall to create the interference fit.

2. The paneling system according to claim 1, wherein each of the panels has a parallelogram shape.

3. The paneling system according to claim 2, wherein each of the panels has a rectangular shape.

4. The paneling system according to claim 1, wherein each of the panels has a hexagonal shape.

5. The paneling system according to claim 1, wherein each of the panels has the side edges having the lateral motion limiting male joint element, which are identical in length to the side edges having the lateral motion limiting female joint element complementary to the lateral motion limiting male joint element.

6. The paneling system according to claim 1, wherein the hook joint is vertically engageable.

7. The paneling system according to claim 1, further comprising a clip for covering the groove joint of one or more panels of a last row of panels, wherein the clip engages the groove joint of the one or more panels of a last row of panels.

8. The paneling system according to claim 1, wherein the lateral motion limiting female joint element comprises an upwardly projected rib, wherein the lateral motion limiting male joint element comprises an upwardly directed channel, wherein upon placing the lateral motion limiting male joint element over and into the lateral motion limiting female joint element, the downwardly projected rib of the lateral motion limiting male joint element enters a corresponding downwardly directed channel of the lateral motion limiting female joint element and the upwardly projected rib of lateral motion limiting female joint element enters a corresponding upwardly directed channel of the lateral motion limiting male joint element forming the hook joint.

9. The paneling system according to claim 8, wherein the downwardly directed channel of the lateral motion limiting female joint element has a dimension x and the downwardly projected rib of the lateral motion limiting male joint element has a corresponding dimension y, wherein the dimension y of the downwardly projected rib lateral motion limiting male joint element is greater than the dimension x of the downwardly directed channel of the lateral motion limiting female joint element, such that upon placing the lateral motion limiting male joint element over and into the lateral motion limiting female joint element, an interference in movement between the lateral motion limiting female joint element and the lateral motion limiting male joint element is established.

10. The paneling system, according to claim 1, wherein each of the panels comprises a top and a bottom, wherein the plane of the interconnected panels is parallel to the top of the panel and parallel to the bottom of the panel when the panel is interconnected with other panels.

11. The paneling system according to claim 1, wherein the interconnecting panels are wood composite interconnecting panels.

12. The paneling system according to claim 1, wherein the interconnecting panels are laminated wood composite interconnecting panels.

13. The paneling system according to claim 1, wherein the channel distance between the top of the first channel wall and the top of the second channel wall is the distance between a first top of the first channel raised surface component on the first channel wall and a second top of the second channel raised surface component on the second channel wall.

14. The paneling system according to claim 1, wherein the interference fit is caused by friction between the first channel raised surface component and the first rib wall and friction between the second channel raised surface component and the second rib wall.

15. The paneling system according to claim 14, wherein the lateral motion limiting female joint element comprises an upwardly projected rib, wherein when the hook joint is formed there exists a space for the upwardly projected rib of the lateral motion limiting female joint element to flex into as the second channel raised surface component pushes on the second rib wall and the second rib wall pushes back on the second channel raised surface component, such that the flexing of the upwardly projected rib of the lateral motion limiting female joint element into the space creates tension to cause the second channel raised surface component to push on the second rib wall to create the interference fit.

16. The paneling system according to claim 1, further comprising a means for sealing along the tongue and groove joint and along the hook joint.

17. The paneling system according to claim 1, wherein each of the panels is composed of wood.

18. A method for installing interconnecting panels, comprising:

a) installing a first row of interconnecting panels, wherein each of the panels comprises a side edge having a tongue, a side edge having a groove that is complementary to the tongue, at least one side edge having a lateral motion limiting male joint element, and at least one side edge having a lateral motion limiting female joint element that is complementary to the lateral motion limiting male joint element, wherein the side edge having the tongue and the side edge having the groove are located at opposite sides on each of the panels, wherein the at least one side edge having the lateral motion limiting female joint element and the at least one side edge having the lateral motion limiting male joint element are located at opposite sides of each of the panels, wherein the tongue of each of the panels is configured to interconnect with the groove of another panel to form a tongue and groove joint such that the interconnected panels lie in a plane of the interconnected panels, wherein the tongue and groove joint prevents lateral movement of the interconnected panels away from and toward each other in a direction perpendicular to the tongue and groove joint in the plane of the interconnected panels and prevents movement of the interconnected panels with respect to each other in a direction perpendicular to the plane of the interconnected panels, wherein the lateral motion limiting female joint element of each of the panels is configured to interconnect with the lateral motion limiting male joint element of another panel to form a hook joint such that the interconnected panels lie in the plane of the interconnected panels, wherein the hook joint prevents movement of the interconnected panels away from and toward each other in a direction perpendicular to the hook joint in the plane of the interconnected panels, wherein the hook joint allows movement of the interconnected panels with respect to each other in a direction perpendicular to the plane of the interconnected panels, wherein the hook joint hinders motion of the interconnected panels in a direction perpendicular to the plane of the interconnected panels, wherein the motion of the interconnected panels in a direction perpendicular to the plane of the interconnected panels is hindered via an interference fit between the lateral motion limiting male joint element and the lateral motion limiting female joint element created when the hook joint is formed, wherein the interference fit is due to tension between the lateral motion limiting male joint element and the lateral motion limiting female joint element when the hook joint is formed, wherein the lateral motion limiting male joint element comprises a downwardly projected rib and the lateral motion limiting female joint element comprises a downwardly directed channel for receiving the rib to form the hook joint, wherein the channel comprises a first channel wall that forms a first angle greater than zero with a normal to the plane of the interconnected panels and a second channel wall that is parallel to the normal of the plane of the interconnected panels, wherein the rib comprises a corresponding first rib wall that forms a second angle greater than zero with the normal to the plane of the interconnected panels and the second rib wall that is parallel to the normal of the plane of the interconnected panels, wherein a channel distance between a top of the first channel wall and a top of the second channel wall is less than a rib distance between a top of the first rib wall and a top of the second rib wall resulting in the interference fit when the hook joint is formed, wherein the downwardly directed channel comprises a first channel raised surface component on the first channel wall and a second channel raised surface component on the second channel wall, and wherein when the hook joint is formed the first channel raised surface component pushes on the first rib wall and the second channel raised surface component pushes on the second rib wall to create the interference fit, wherein installing a first row of panels comprises:

i) positioning a first panel of a first row of panels on a surface on which the panels are to be installed;

ii) interconnecting a second panel of the first row of panels to the first panel of the first row of panels so that the lateral motion limiting male or female joint element of the second panel of the first row of panels is interconnected with the lateral motion limiting female or male joint element of the first panel of the first row of panels to form a hook joint between the first panel of the first row of panels and the second panel of the first row of panels;

iii) interconnecting an additional panel of the first row of panels to the last positioned panel of the first row of panels so that the lateral motion limiting male or female joint element of the additional panel of the first row of panels is interconnected with the lateral motion limiting female or male joint element of the last positioned panel of the first row of panels to form a hook joint between the first panel of the additional row of panels and the last positioned panel of the first row of panels; and iv) repeating step iii) until a desired number of panels are positioned in the first row;

b) installing an additional row of interconnecting panels, wherein installing the additional row of interconnecting panels comprises:

i) inserting at an angle relative to the plane of the interconnected panels, the tongue of a first panel of the additional row of panels into the groove of one or more panels, including the first panel, of the prior positioned row;

ii) rotating the first panel of the additional row of panels so as to interconnect the tongue of the first panel of the additional row of panels with the groove of one or more panels, including the first panel, of the prior positioned row of panels to form a tongue-and-groove joint between the first panel of the additional row of panels and one or more panels, including the first panel, of the prior positioned row of panels;

iii) inserting at an angle relative to the plane of the interconnected panels, the tongue of a second panel of the additional row of panels into the groove of one or more panels of the prior positioned row of panels such that the lateral motion limiting male or female joint element of the second panel of the additional row of panels aligns with the lateral motion limiting female or male joint element of the first panel of the additional row of panels;

iv) rotating the second panel of the additional row of panels so as to interconnect the tongue of the second panel of the additional row of panels with the groove of one or more panels of the prior positioned row of panels to form a tongue and groove joint between the second panel of the additional row of panels with one or more panels of the prior positioned row of panels and simultaneously interconnecting the lateral motion limiting male or female joint element of the second panel of the additional row of panels with the lateral motion limiting female or male joint element of the first panel of the additional row of panels to form a hook joint between the first panel of the additional row of panels and second panel of the additional row of panels;

v) inserting at an angle relative to the plane of the interconnected panels, the tongue of an additional panel of the additional row of panels into the groove of one or more panels of the prior positioned row of panels such that the lateral motion limiting male or female joint element of the additional panel of the additional row of panels aligns with the lateral motion limiting female or male joint element of the last positioned panel of the additional row of panels;

vi) rotating the additional panel of the additional row of panels so as to interconnect the tongue of the additional panel of the additional row of panels with the groove of one or more panels of the prior positioned row of panels to form a tongue and groove joint between the additional panel of the additional row of panels with one or more panels of the prior positioned row of panels and simultaneously interconnecting the lateral motion limiting male or female joint element of the additional panel of the additional row of panels with the lateral motion limiting female or male joint element of the last positioned panel of the additional row of panels to form a hook joint between the last positioned panel of the additional row of panels and the additional panel of the additional row of panels;

vii) repeating steps i) through vi) until a desired number of panels are positioned in the additional row; and c) repeating step b) until a desired number of rows of panels are positioned onto the surface.

19. The method according to claim 18, wherein the tongue of the panel of the second or additional rows of panels is interconnected with the groove of more than one panel of the first or prior rows of panels.

20. The method according to claim 18, wherein each of the panels has a rectangular shape.

21. The method according to claim 18, wherein each of the panels has a parallelogram shape.

22. The method according to claim 18, wherein each of the panels has a hexagonal shape.

23. The method according to claim 18, wherein each of the panels has the side edges having the lateral motion limiting male joint element that are identical in length to the side edges having the lateral motion limiting female joint element complementary to the lateral motion limiting male joint element.

24. The method according to claim 18, further comprising sealing along the tongue and groove joint and along the hook joint.

25. The method according to claim 18, wherein each of the panels is composed of wood.

26. The method according to claim 18, further comprising:

a) disassembling a plurality of interconnected panels from the installed panels comprising rotating a last panel installed in a last row of panels into an upward position relative to the plane of the interconnected panels to disengage the lateral motion limiting male or female joint element of the last panel installed in the last row of panels from a lateral motion limiting female or male joint element of a second to last panel installed in the last row of panels and withdrawing the tongue of the last panel installed in the last row of panels from the groove of one or more panels installed in the second to last row of panels to disengage the last panel from one or more panels installed in the second to last row of panels; and b) repeating step a) until a desired number of panels are disengaged from the interconnected paneling system.

27. The method according to claim 18, wherein the tongue and groove joint is rotatably engageable.

28. The method according to claim 18, wherein the hook joint is vertically engageable.

29. The method according to claim 18, further comprising finishing the interconnecting panels, wherein finishing the interconnecting panels comprises: placing a clip for covering the groove joint of one or more panels of a last row of panels into the groove of one or more panels of a last row of panels.

30. The method according to claim 18, wherein each of the panels comprises a top and a bottom, wherein the plane of the interconnected panels is parallel to the top of the panel and parallel to the bottom of the panel when the panel is interconnected with other panels.

31. The method according to claim 18, wherein the interconnecting panels are wood composite interconnecting panels.

32. The method according to claim 18, wherein the interconnecting panels are laminated wood composite interconnecting panels.

33. The method according to claim 18, wherein the channel distance between the top of the first channel wall and the top of the second channel wall is the distance between a first top of the first channel raised surface component on the first channel wall and a second top of the second channel raised surface component on the second channel wall.

34. The method according to claim 18, wherein the interference fit is caused by friction between the first channel raised surface component and the first rib wall and friction between the second channel raised surface component and the second rib wall.

35. The method according to claim 34, wherein the lateral motion limiting female joint element comprises an upwardly projected rib, wherein when the hook joint is formed there exists a space for the upwardly projected rib of the lateral motion limiting female joint element to flex into as the second channel raised surface component pushes on the second rib wall and the second rib wall pushes back on the second channel raised surface component, such that the flexing of the upwardly projected rib of the lateral motion limiting female joint element into the space creates tension to cause the second channel raised surface component to push on the second rib wall to create the interference fit.

36. The method according to claim 18, wherein the lateral motion limiting female joint element comprises an upwardly projected rib, wherein the lateral motion limiting male joint element comprises an upwardly directed channel, wherein upon placing the lateral motion limiting male joint element over and into the lateral motion limiting female joint element, the downwardly projected rib of the lateral motion limiting male joint element enters a corresponding downwardly directed channel of the lateral motion limiting female joint element and the upwardly projected rib of lateral motion limiting female joint element enters a corresponding upwardly directed channel of the lateral motion limiting male joint element forming the hook joint.

37. The method according to claim 36, wherein the downwardly directed channel of the lateral motion limiting female joint element has a dimension x and the downwardly projected rib of the lateral motion limiting male joint element has a corresponding dimension y, wherein the dimension y of the downwardly projected rib lateral motion limiting male joint element is greater than the dimension x of the downwardly directed channel of the lateral motion limiting female joint element, such that upon placing the lateral motion limiting male joint element over and into the lateral motion limiting female joint element, an interference in movement between the lateral motion limiting female joint element and the lateral motion limiting male joint element is established.

38. The method according to claim 18, further comprising covering the groove joint of one or more panels of a last row of panels with a clip, wherein the clip engages the groove joint of the one or more panels of a last row of panels.

* * * * *